US006220196B1

(12) United States Patent
Escarrat

(10) Patent No.: US 6,220,196 B1
(45) Date of Patent: Apr. 24, 2001

(54) WATER DISCHARGE DEVICE FOR A SUBMERGED LAUNCHING SYSTEM

(75) Inventor: Pierre Escarrat, Toulon (FR)

(73) Assignee: Etat Francais Represente Par le Delegue General pour l'Armement, Armees (FR)

( * ) Notice: Subject to any disclaimer, the term of this patent is extended or adjusted under 35 U.S.C. 154(b) by 0 days.

(21) Appl. No.: 09/075,933

(22) Filed: May 12, 1998

(30) Foreign Application Priority Data

May 15, 1997 (FR) ..... 97 05960

(51) Int. Cl.[7] ..... B63B 5/00
(52) U.S. Cl. ..... 114/238

(58) Field of Search ..... 114/318, 319, 114/238

(56) References Cited

U.S. PATENT DOCUMENTS

| | | | | |
|---|---|---|---|---|
| 925,707 | * | 6/1909 | Lake | 114/319 |
| 2,837,971 | | 6/1958 | Wosak | 89/5 |
| 2,848,970 | | 8/1958 | Gunning | 114/17 |
| 2,989,899 | * | 6/1961 | Siegel et al. | 114/319 |
| 3,773,025 | | 11/1973 | Roeder et al. | 124/11 |
| 4,523,538 | | 6/1985 | Hollmann et al. | 114/238 |
| 4,848,210 | * | 7/1989 | Bissonnette | 89/1.81 |
| 5,044,253 | * | 9/1991 | Moody | 89/1.81 |
| 5,085,122 | * | 2/1992 | Berlam et al. | 89/1.81 |

(List continued on next page.)

FOREIGN PATENT DOCUMENTS

| | | |
|---|---|---|
| 34 06 921 A1 | 9/1985 | (DE) . |
| 0 151 980 | 8/1985 | (EP) . |

*Primary Examiner*—Charles T. Jordan
*Assistant Examiner*—Denise J Buckley
(74) *Attorney, Agent, or Firm*—Oliff & Berridge, PLC

(57) ABSTRACT

The invention relates to a water discharge device for a system for launching objects, including torpedoes, mines, or missiles, from at least one tube built into a fixed or movable submerged structure (e.g., a submarine). The tube is provided with at least one end door and one slide valve connecting it hydraulically to the water ram by a impulse tank filled with water. The impulse tank is built into the submarine hull, and comprises a closed, sealed space in which the water is driven to the tube, under the influence of a leading pneumatic ram acting on a following hydraulic ram controlled by the water contained in the chamber and previously drawn in from the marine environment by an intake line. The chamber is immovably located outside the hull. The pneumatic ram and the hydraulic ram of the water ram are removable and independent so that they can be placed in the chamber or be dissociated therefrom, without maintenance work being performed on the hull, and with only the fluid or electrical connections and launch tubes, properly passing through the hull. The device also has a compressed-gas reservoir directly connected to the piston of the leading pneumatic ram to drive and displace it, with no intermediate line. The piston is connected to an annular discharge piston forming a concentric crown around the pneumatic ram. The piston is able to move linearly and simultaneously with the annular discharge piston, in the corresponding concentric interior of the hydraulic ram. Furthermore, the link between the leading pneumatic piston and the following hydraulic piston is comprised of a yoke connected at its center to an exiting end perpendicular to the leading piston and connected by its free ends to parallel connecting rods and also connected with the concentric following discharge piston. This structure constitutes an integrated coupling movable with respect to the interiors of the pneumatic ram and the hydraulic ram.

20 Claims, 11 Drawing Sheets

U.S. PATENT DOCUMENTS

| | | | | |
|---|---|---|---|---|
| 5,099,745 | | 3/1992 | Hubbell et al. | 89/1.8 |
| 5,165,360 | | 11/1992 | Moody | 114/319 |
| 5,231,241 | | 7/1993 | Bissonnette | 89/1.81 |
| 5,249,933 | * | 10/1993 | Moody | 417/404 |
| 5,277,144 | * | 1/1994 | Moody | 114/319 |
| 5,284,106 | * | 2/1994 | Meng | 114/238 |
| 5,410,978 | * | 5/1995 | Walclawik et al | 114/238 |
| 5,438,948 | | 8/1995 | Moody | 114/319 |
| 5,568,782 | * | 10/1996 | Moody | 114/238 |

* cited by examiner

WATER DISCHARGE DEVICE FOR A SUBMERGED LAUNCHING SYSTEM

BACKGROUND OF THE INVENTION

The invention relates to a water discharge device designed for a system for launching objects from submerged tubes installed on board a submarine or any other type of launcher or movable or fixed submerged structure.

Known devices of this type are used in the military area to launch objects from torpedo tubes on submarines. These devices, illustrated in FIGS. 1, 2, and 3, are essentially composed of several tubes (a) for launching torpedoes (b) (a single tube is shown in the figures) with doors (c) at their ends and a slide valve (d). These torpedo tubes are connected to a water discharge device by a impulse tank (e) located outside the pressure hull (f) of the submarine (FIGS. 1 and 3), or inside the pressure hull when the size of the latter permits (FIG. 2). Impulse tank (e) forms a closed, sealed space into which the water discharge device discharges.

According to FIGS. 1 and 2, the water discharge device, called a water ram, is comprised of a pneumatic ram (g) which is located inside the pressure hull of the submarine and which drives, through a mechanical linkage passing through the pressure hull (f), a piston (h) a of hydraulic ram (i) located outside. A high-pressure compressed-air reservoir provided with a firing valve is located near pneumatic ram (g) and supplies the latter with the power necessary for launching. A line (j) extends the hydraulic ram up to the outer hull of the submarine and channels seawater drawn in from the marine environment when the hydraulic piston moves. Certain water discharge devices are equipped with a depth-pressure-resistant line and are provided with a door. A muffler is installed at the exhaust and the drain of the pneumatic ram.

European Patent Application EP 0151980 describes and claims a water ram variant that consists of replacing the pneumatic valve, supplied with compressed air, by a hydraulic ram supplied by a hydraulic fluid, coming from an air-oil accumulator. Another variant, which to date has not been reduced to practice, replaces the pneumatic ram by a linear motor.

According to FIG. 3, the water discharge device is a turbopump comprised of an air turbine (k) located inside the pressure hull of a submarine, driving a pump (m) located outside through a speed reduction unit (1). A line (n) extends pump (m) up to the outer hull of the submarine and channels the seawater drawn in from the marine environment when the pump operates. A compressed-air circuit composed of an air reservoir (o) and a firing valve (p) supplies turbine (k) when the device is implemented. A muffler is installed at the turbine exhaust.

The operating principle of these devices is described briefly below:

When a water ram actuated by a pneumatic ram is used (FIGS. 1 and 2) for a launch, as soon as the firing valve opens, the hydraulic piston driven by the pneumatic ram supplied with high-pressure compressed air from the reservoir, drives the seawater via the impulse tank to the torpedo tube in question, the slide valve of which is open. When the rear of the torpedo tube is pressurized, the weapon is ejected outside the submarine.

In the case of a device using a turbopump (FIG. 3), the firing valve supplies the turbine with compressed air, which drives the pump via the speed reduction unit. The pump drives the water taken from the marine environment to the rear of the weapon via the impulse tank and the side openings in the torpedo tube. The hydraulic pressure thus established, pushes the weapon out of the torpedo tube.

However, these devices, widely used on submarines, have a number of drawbacks inherent in their design and operating principle. For example, for launching devices using a water ram type device actuated by a pneumatic ram, these drawbacks are as follows:

1) These water ram devices are installed while the submarine is being built and before the bow is installed. These devices stay installed for the lifetime of the craft. The pneumatic ram plus hydraulic ram assembly takes up a great deal of space on either side of the pressure hull and requires an opening to be made in the hull through which the rod of the pneumatic ram slides. When not in use, keeping the device in the "armed" position exposes the mechanical link between the pneumatic ram and the hydraulic piston to stresses from the marine environment (fouling and encrustation).
2) The integrity of the pressure hull is provided by dynamic seals located on the rod of the pneumatic ram, and the surface condition of this link is essential as it must not deteriorate during its translational movement because the seals ensure the watertightness of the pressure hull. This requires frequent maintenance (periodic emptying of the device while on patrol) to preserve a sufficient surface condition so as not to stress the seals.
3) If the seals fail, there is nothing to prevent the seawater entering the craft if the water intake line is insufficiently strong and not equipped with a hull door.
4) When the weapon is being ejected, the operation of the device causes high-speed displacement of the pneumatic ram and the hydraulic ram which are tightly nested in the internal structures and the pressure hull of the submarine. This movement brings about substantial vibrations, which are a noise source that could render the craft detectable by the enemy. During this same phase, admission of compressed air into the drive of the pneumatic ram causes substantial noise.
5) During a lay-up or while the device is being prepared for a further ejection following a launch, exhausting the compressed air in the drive of the pneumatic ram, which takes place in the cramped interior of a submarine, causes the pressure in this enclosure to rise and the submarine atmosphere to cool off noticeably, especially when several ejections are effected over a relatively short space of time. This bleed causes airborne noise inside the submarine which travels across the sea, thus causing the craft to be even noisier.

For launch devices using a turbopump, the drawbacks are as follows:

1) Installation of a turbopump requires a large opening to be created in the forward bulkhead of the submarine. If the turbopump has to be taken apart for maintenance, appropriate maintenance devices must be used requiring a clear passage inside the craft and clearance in the hull for the outside diameter of the mount holding the turbopump to the forward bulkhead of the submarine.
2) The integrity of the pressure hull is provided by mechanical pump elements resistant to depth pressure but also by dynamic seals located on the pump drive shaft that passes through the pressure hull of the submarine.
3) If the seals fail, there is nothing to prevent seawater from penetrating the craft if the water intake line is insufficiently strong and not equipped with a hull plug.

4) Operation of the turbine, in addition to overpressure and cooling of the atmosphere inside the submarine due to escape of the expanded air, creates serious physiological hazards for the crew when a mass of high-pressure air expands within a very short space of time. This sudden expansion produces a very loud airborne noise that requires a large muffler if its effects are to be attenuated.

SUMMARY OF THE INVENTION

An object of the invention is to remedy the drawbacks of these known devices by modifying the design of the water ram in order better to use the pneumatic energy that ensures operation with a lower noise level and without the drawbacks inherent in expansion of compressed air in a small space. Another object of the invention is to eliminate a translationally or rotationally movable element passing through the pressure hull and potentially compromising the integrity of the pressure hull.

Further objects of the invention are to eliminate periodic cleaning of the pneumatic ram rod, and to offer a water ram whose maintenance does not require long lay-ups of the submarine.

The invention enables these objects to be achieved and for this purpose relates to a water discharge device, or water ram, for a system for launching objects, including torpedoes, mines, or missiles, from at least one tube built into a fixed or movable submerged structure (e.g., a submarine). The tube is provided with at least one end door and one slide valve connecting it hydraulically to the water ram by a impulse tank filled with water. The impulse tank is built into the submarine hull, and comprises a closed, sealed space in which the water is driven to the tube, under the influence of a leading pneumatic ram acting on a following hydraulic ram controlled by the water contained in the chamber and previously drawn in from the marine environment by an intake line. The chamber is immovably located outside the hull. The pneumatic ram and the hydraulic ram of the water ram are removable and independent so that they can be placed in the chamber or be dissociated therefrom, without maintenance work being performed on the hull, and with only the fluid or electrical connections and launch tubes, properly passing through the hull.

According to another characteristic of the invention, the device has a compressed-gas reservoir directly connected to the piston of the leading pneumatic ram to drive and displace it, with no intermediate line. The piston is connected to an annular discharge piston forming a concentric crown around the pneumatic ram. The piston is able to move linearly and simultaneously with the annular discharge piston, in the corresponding concentric interior of the hydraulic ram.

According to another characteristic of the invention, the link between the leading pneumatic piston and the following hydraulic piston is comprised of a yoke connected at its center to an exiting end perpendicular to the leading piston and connected by its free ends to parallel connecting rods and also connected with the concentric following discharge piston. This structure constitutes an integrated coupling movable with respect to the interiors of the pneumatic ram and the hydraulic ram.

Other advantages will emerge from the description hereinbelow, for example:

1) The diameter of the hydraulic piston is increased so that its displacement speed during ejection is less than that of a hydraulic piston of a known system.

2) The pneumatic ram is directly supplied by the compressed-gas reservoir, which eliminates piping and distribution systems creating pressure losses and noise source singularities. Moreover, the velocity of the compressed gas as it expands will be that of the displacement of the hydraulic piston.

3) The pneumatic ram operates on the principle of an air-oil accumulator without the necessity, in a series of several successive ejections, of exhausting off the compressed gas since the device is returned to the "armed" position by the available space of the pneumatic ram being refilled with hydraulic fluid by means of a high-pressure pump. Displacement of the pneumatic piston thus re-compresses the gas reservoir.

4) The assembly comprised of the pneumatic ram and the hydraulic ram, nested into each other, is located outside the pressure hull of the submarine with no links therewith other than those of mechanical attachment, fluid, electrical, and monitoring types for this assembly.

5) The assembly thus created is attached to the outer structure of the submarine by mechanical elastic-type links in order to reduce transmission of vibrations to the submarine hull.

6) Except for the very short phase during which the water ram is in use, while placing the pneumatic piston rod in the extended position, the rod is held in the stowed position due to the available space in the pneumatic ram being filled with hydraulic fluid and hence protected from stresses from the marine environment.

7) The water ram can be uncoupled from the submarine simply by disassembling the mechanical connecting links and the fluid and electrical circuit links with minimum effort, thus allowing easier maintenance in the shop or replacement of a complete assembly in minimum time.

8) The equipment installed in the pressure hull takes up limited space and does not require special maintenance equipment.

Still other characteristics will emerge from the description hereinbelow and should be considered separately or in all their possible technical combinations.

BRIEF DESCRIPTION OF THE DRAWINGS

This description, provided as a nonlimiting example, will give a better understanding of how the invention may be reduced to practice, with reference to the attached drawings wherein.

DETAILED DESCRIPTION OF PREFERRED EMBODIMENTS

Figure 1:
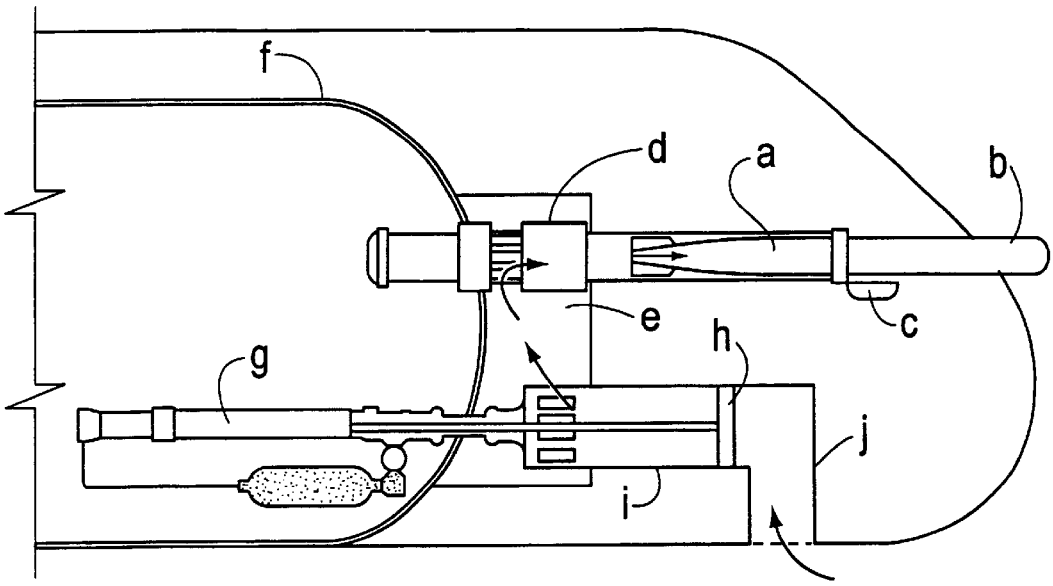
FIG. 1 PRIOR ART
FIG. 1 represents a conventional launching system embodiment.
Figure 2:
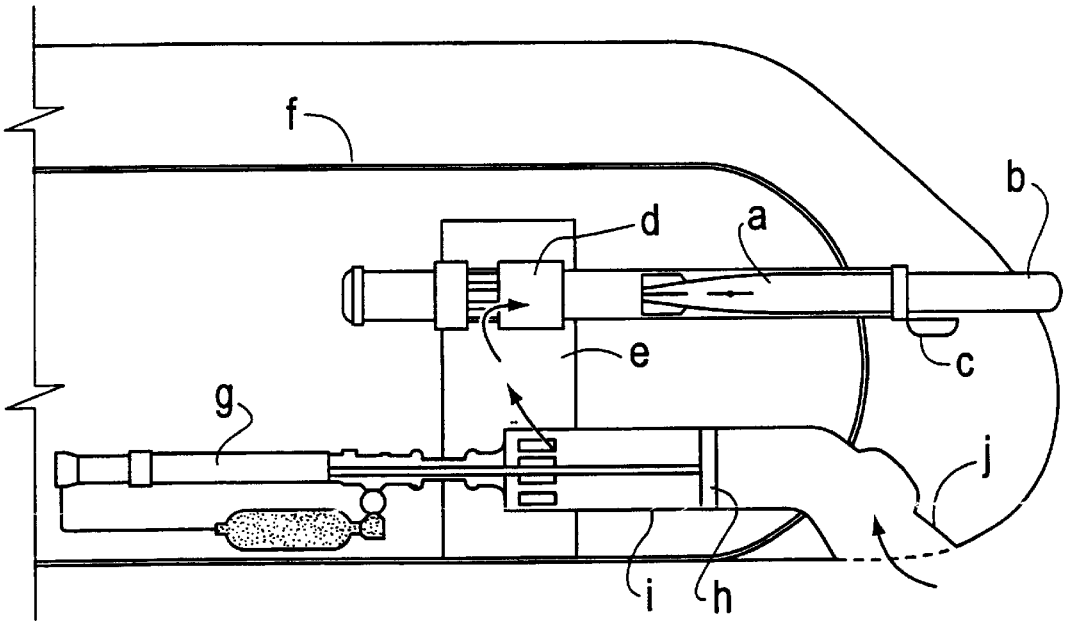
FIG. 2 PRIOR ART
FIG. 2 represents another conventional launching system embodiment.
Figure 3:
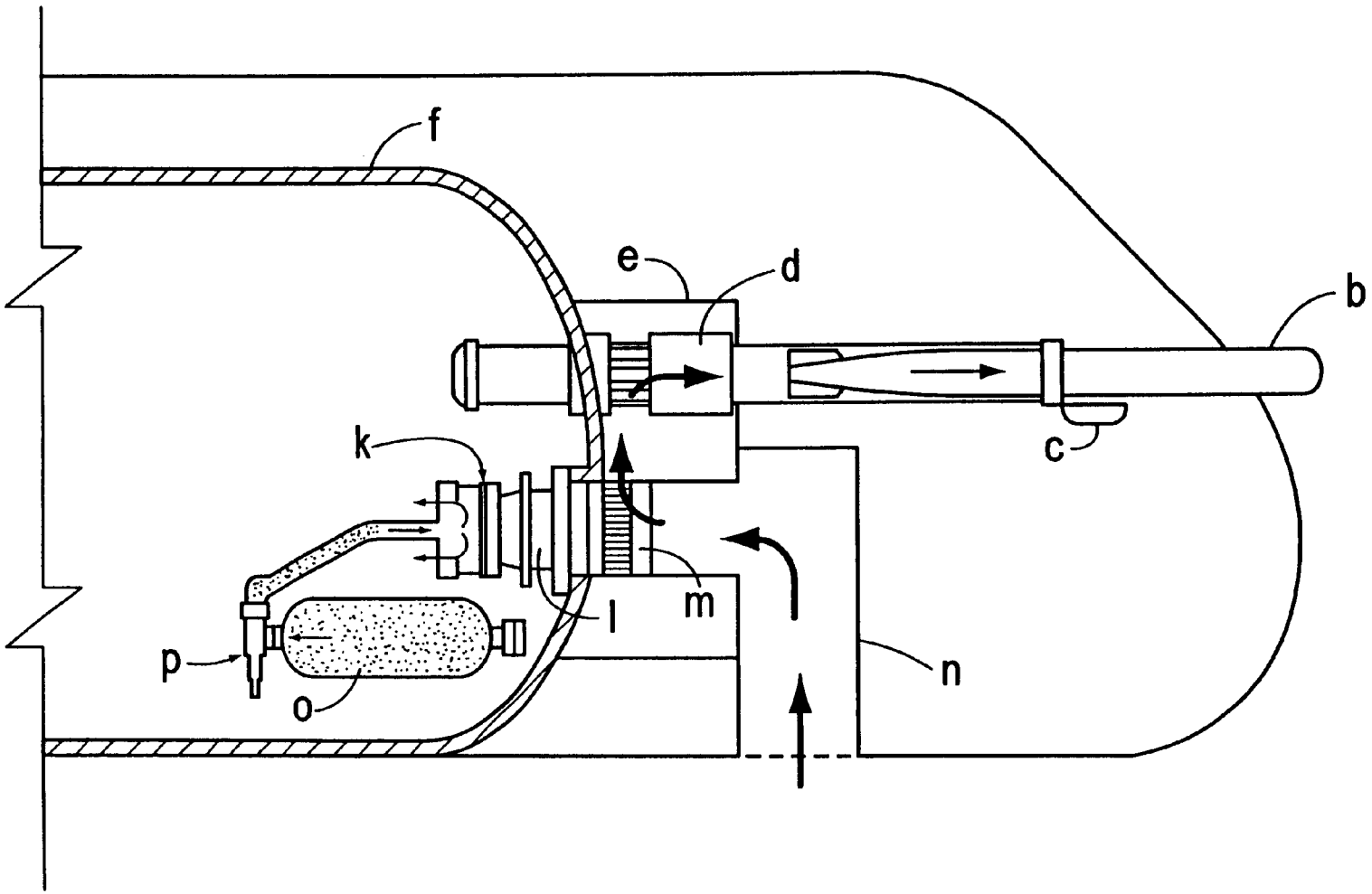
FIG. 3 PRIOR ART
FIG. 3 represents another conventional launching system embodiment.
Figure 4:
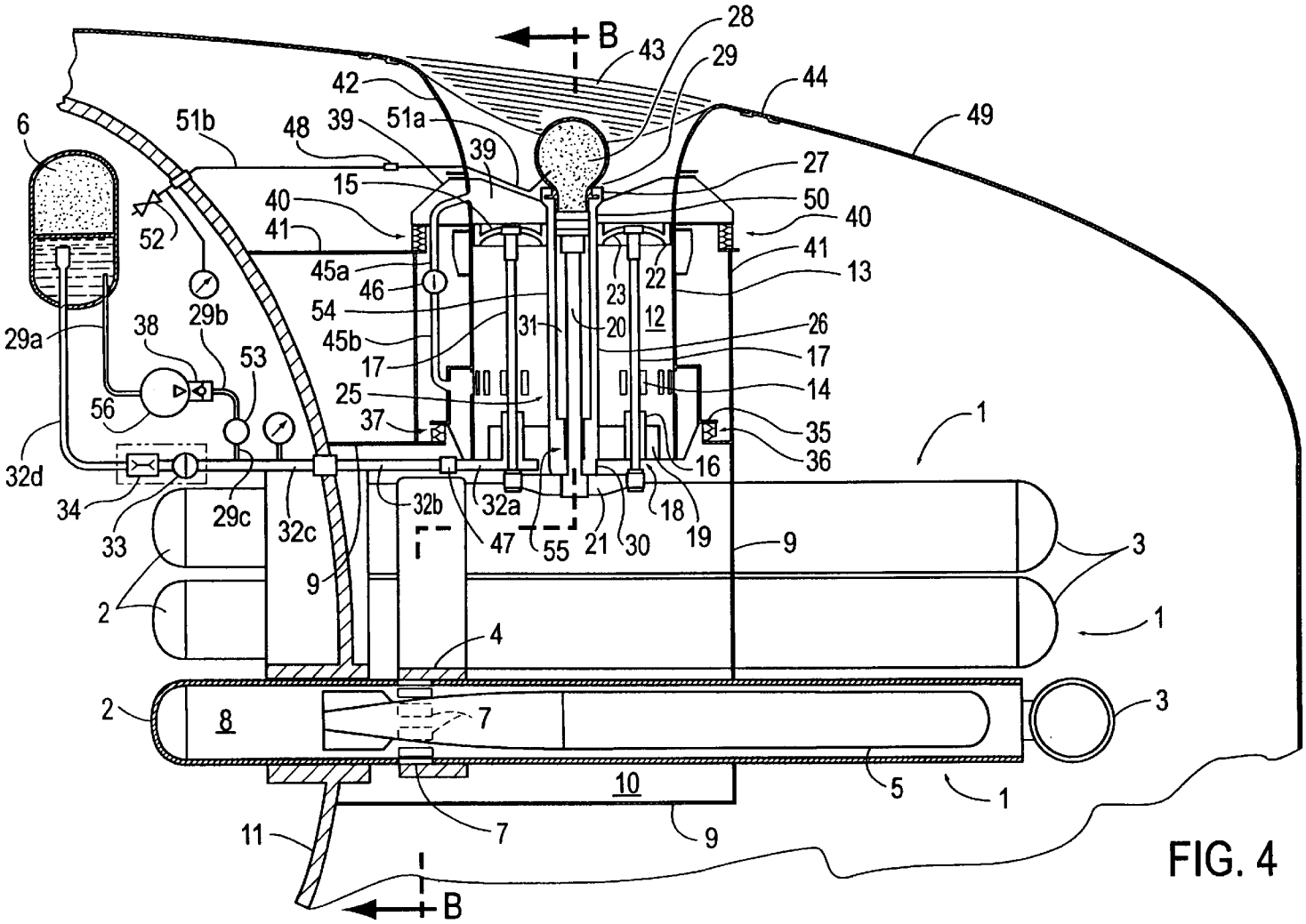
FIG. 4 is an overall view in a section taken along line A—A in FIG. 7.
Figure 5:
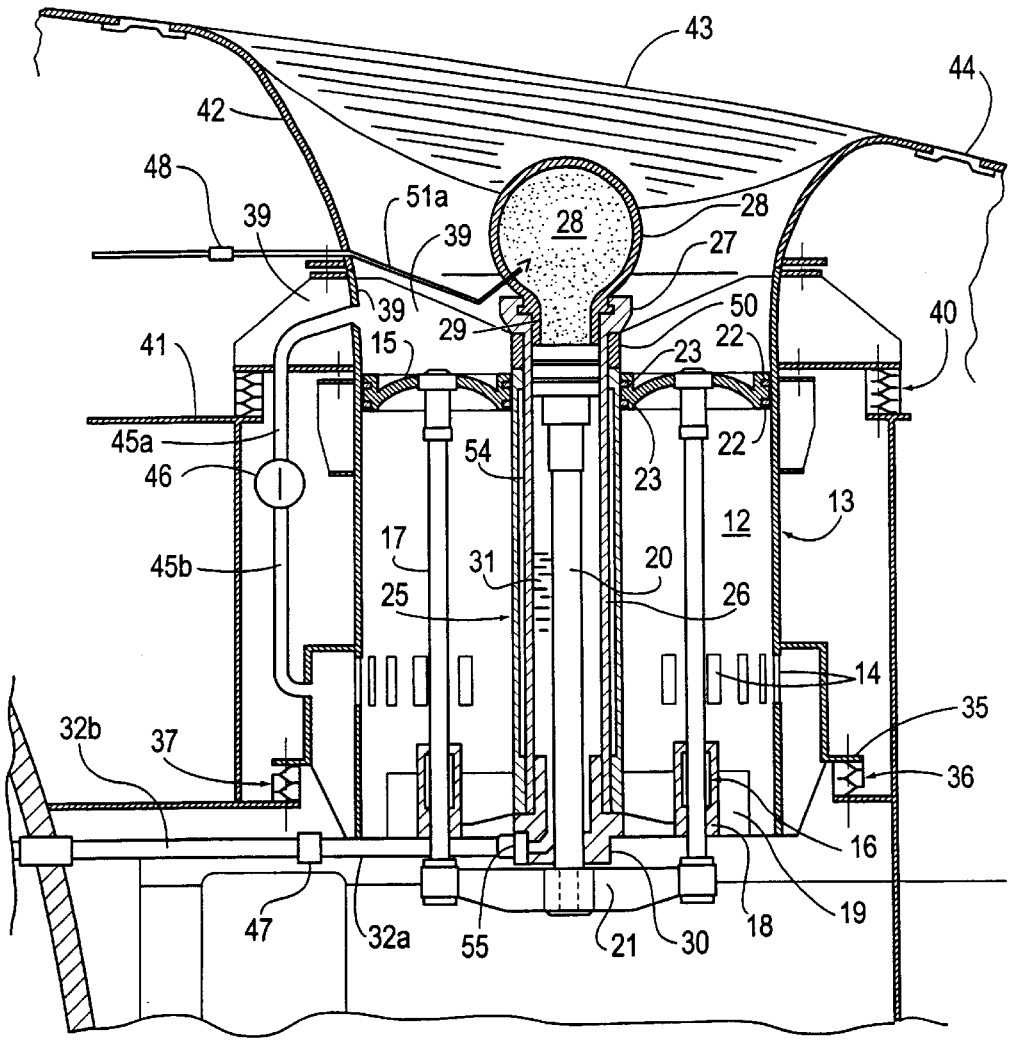
FIG. 5 is a partial view of FIG. 4 on an enlarged scale.

FIGS. 4, 5, 6, and 7 represent an example of the invention on board a submarine equipped with torpedo tubes. In this configuration, which corresponds to the "resting" mode of the device, torpedo tubes 1 containing the weapon 5 to be launched are shown equipped with their rear doors 2 and front doors 3 that can be open or shut. The slide valve 4, which can be open or closed, block the water inlet orifices 7. These orifices provide communication between the interior 8 of the torpedo tube 1 whose slide valve 4 is open, and the interior 10 of a impulse tank 9. It should be noted that, in the example shown, the impulse tank 9 is connected to pressure hull 11 of the submarine, thus creating a closed, sealed space. However, the same sealing function can be provided by another impulse tank arrangement.

The interior 10 of impulse tank 9 communicates with the interior 12 of a hydraulic ram 13 as a result of its open lower part, as well as through ports 14 disposed on the side wall of hydraulic ram 13. The hydraulic ram 13 is connected to the impulse tank 9 by a flange 35 attached by elastic links 36. A seal 37 isolates the interior spaces 10, 12 in the impulse tank 9 from the outside environment.

A pneumatic ram 26 whose flange 27 receives a compressed-gas reservoir 28, is located concentrically inside hydraulic ram 13. Seals 29 isolate the interiors of the ram 26 and the reservoir 28 from the outside environment.

A compressed-gas circuit composed of the circuit lines 51*a*, 51*b*, provides the communication between the interior of the reservoir 28 and a submarine compressed-gas production and distribution source. This circuit can be shut off by a valve 52.

An envelope 25, inside of which is a heat insulator 54, surrounds pneumatic ram 26 to resist heat exchanges by conduction and convection between the expanded, cooled gas from the reservoir 28 when ejection takes place into the outside environment. The temperature of the expanded gas must not cool the wall supporting the hydraulic piston 15 of the hydraulic ram 13, so that icing that will not prevent the latter from returning to its position.

The movement of the pneumatic piston 20 of the ram 26 is transmitted to the concentric hydraulic piston 15 which has a circular shape or any other shape matching that of the hydraulic ram 13, and is annular relative to a yoke 21 and the connecting rods 17 (at least two in number).

The connecting rods 17 are guided translationally by bearings 18, integral with the supports 19 attached to the hydraulic ram 13. Each bearing has associated with it a device 16 that brakes the connecting rods 17 when they reach the end of travel for launching. The hydraulic ram 13 and the envelope 25 of the pneumatic ram 26, whose walls are lined with a material suitable for frictional conditions in the marine environment, serve as a concentric guide for the piston 15. The dynamic seal between the concentric interior space 12 and the outside environment is provided by the seals 22, 23. The seal 22 on the interior space 12 side, is preferably of the scraper ring seal type.

Figure 6:
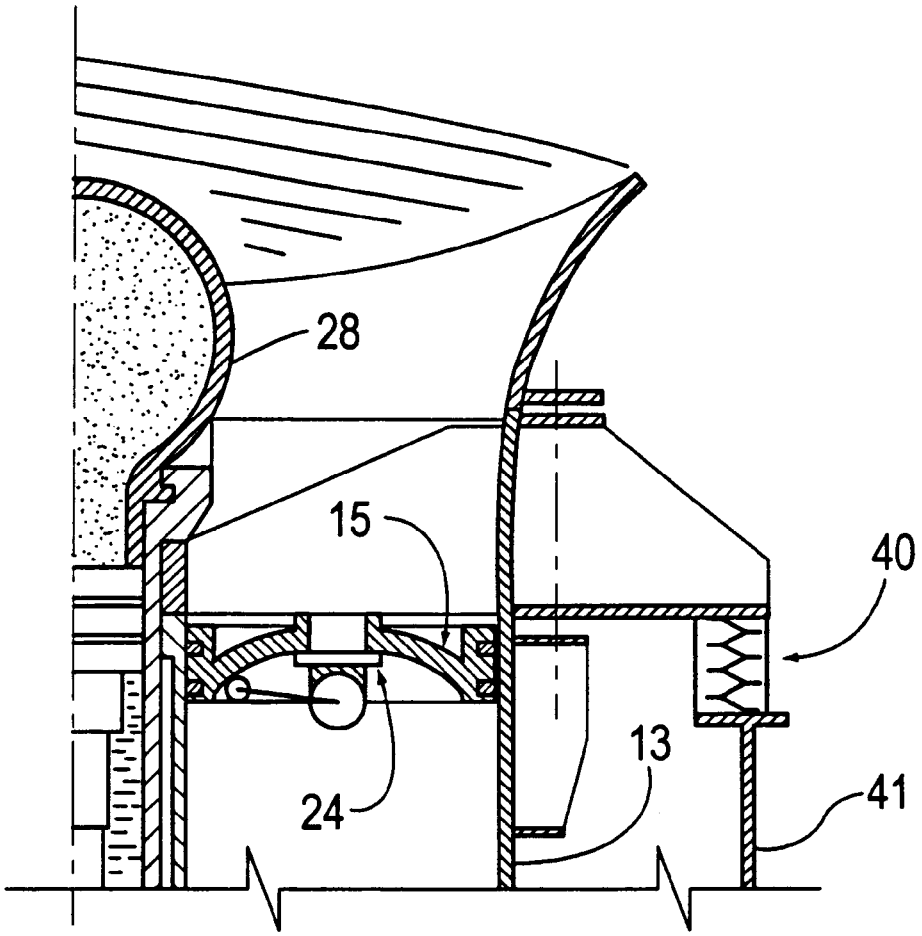
FIG. 6 is a detailed view of FIG. 4 showing a drain float valve with which the hydraulic piston is equipped.
Figure 7:
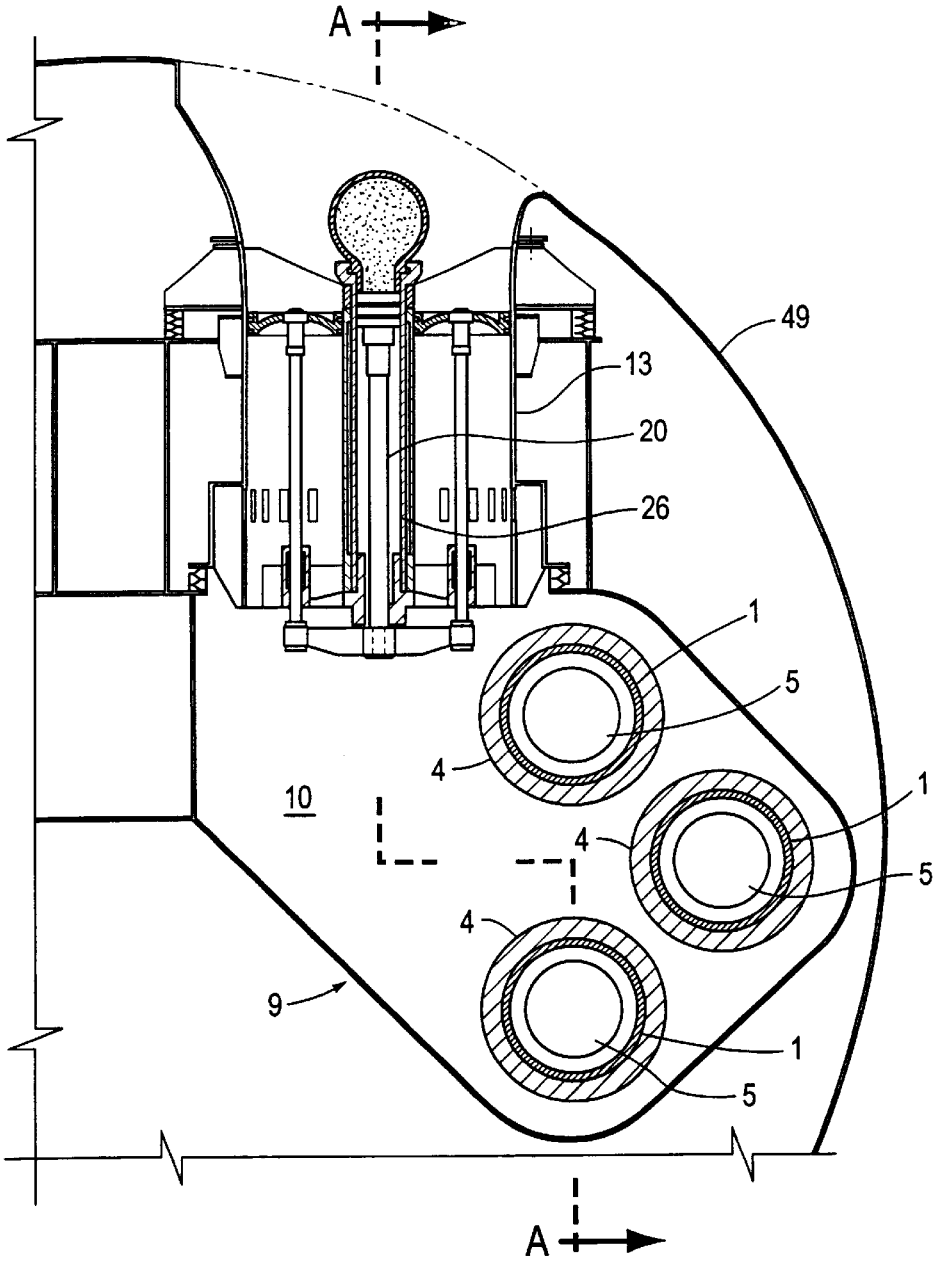
FIG. 7 is a cross-sectional view along line B—B in FIG. 4.

According to FIG. 6, the piston 15 is provided with drain float valves 24 placed between the links with the connecting rods 17. In the position shown, these valves, in addition to draining the air trapped in the interior interior space 12, supply the space 12 with water from the outside when the piston 15 returns to the "armed" position after a launch.

The interior 31 of pneumatic ram 26 contains a hydraulic fluid and can be made to communicate with a compensating tank 6 by means of a circuit comprising a flange 30 to which pipe sections 32*a*–32*d* are connected and through the device combining a valve 33 that can be open or shut and a flow regulator 34 controlling the hydraulic fluid discharged to compensating tank 6 when the piston 20 moves. The movement of the latter is impeded at the end of launch travel by a braking device 55 built into the flange 30.

A hydraulic fluid circuit composed of pipe sections 29*a*–29*c* drives the hydraulic fluid contained in compensating tank 6, by means of a pump 56, into interior space 31 in order to cause the piston 20 to move from its end-of-launch position to the "armed" position. This movement also has the consequence of compressing the volume of expanded gas in the reservoir 28. A valve 53 shuts off this circuit when not in the utilization phase and a check valve 38 prevents the circuit from being pressurized upstream of the valve 53.

Above the hydraulic ram 13 is a support 39 connected by elastic links 40 to a structure 41 integral with the impulse tank 9. This support takes up the forces developed by the pneumatic ram 26 and for this purpose has a link 50 immobilizing the body of the ram 26.

A water intake duct 42 fitted with a grid 43, connects the outer hull 49 to the support 39. A flexible seal 44 ensures continuity of the profile of the outer hull 49.

A circuit composed of pipe sections 45*a*–45*b* and the valve 46, which can be open or closed, equalizes the pressure between the interior spaces 10, 12 and the outside environment, or isolates them altogether from the outside environment.

In this embodiment, the water ram is installed in the upper part of the submarine, but any other arrangement fulfilling the same functions, can be contemplated. The electrical monitoring circuits of the device are not shown.

Figure 8:
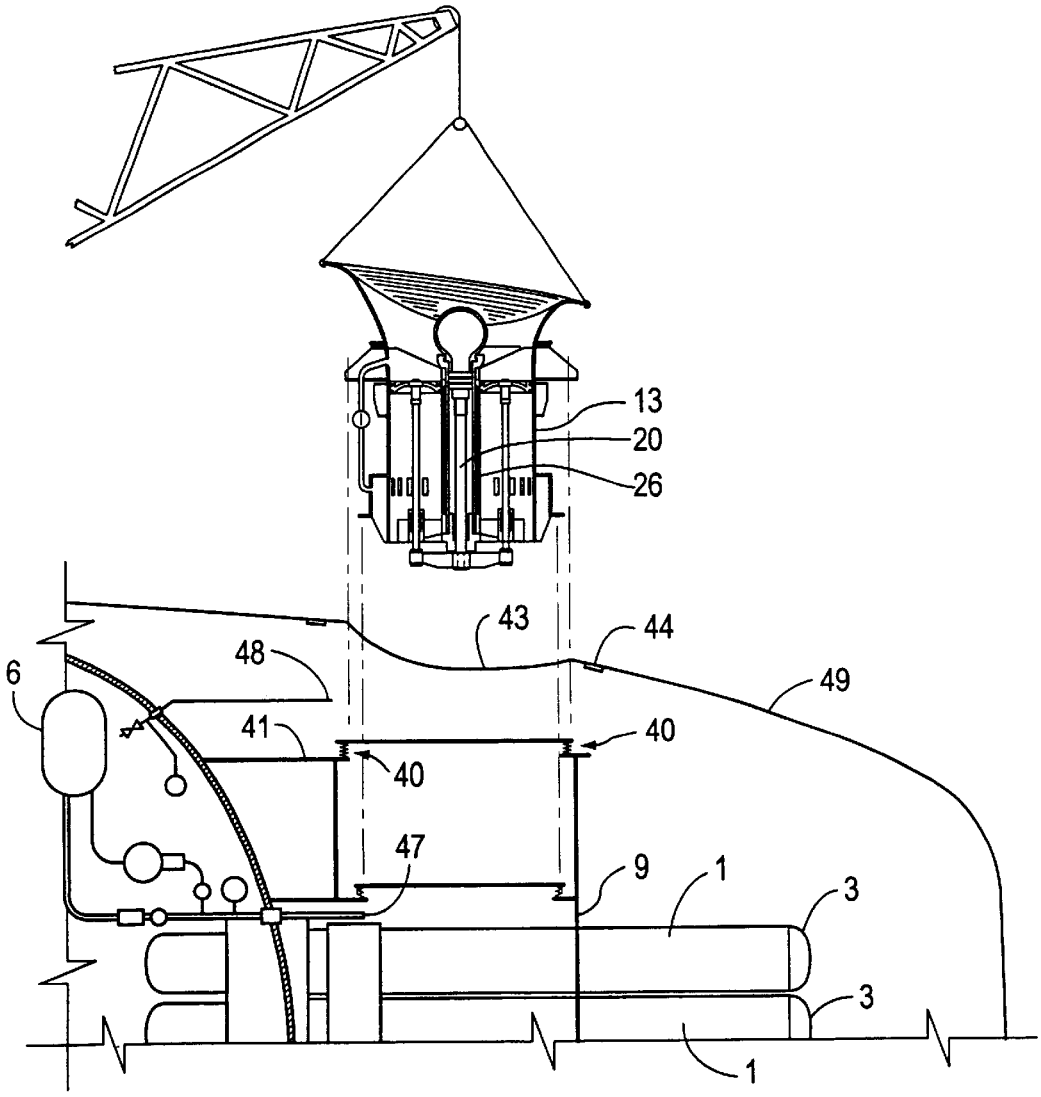
FIG. 8 is a view of the device according to the invention in a maintenance phase.

According to FIG. 8, removable connectors 47, 48, placed between the elements of the lines 32*a*–32*d*, 51*a*–5*b*, are placed such that, after being disconnected, they allow ram assemblies 13, 26 to pass through the openings in the upper part of the chamber 9, in the structure 41, and in the outer hull 49.

Figure 9:
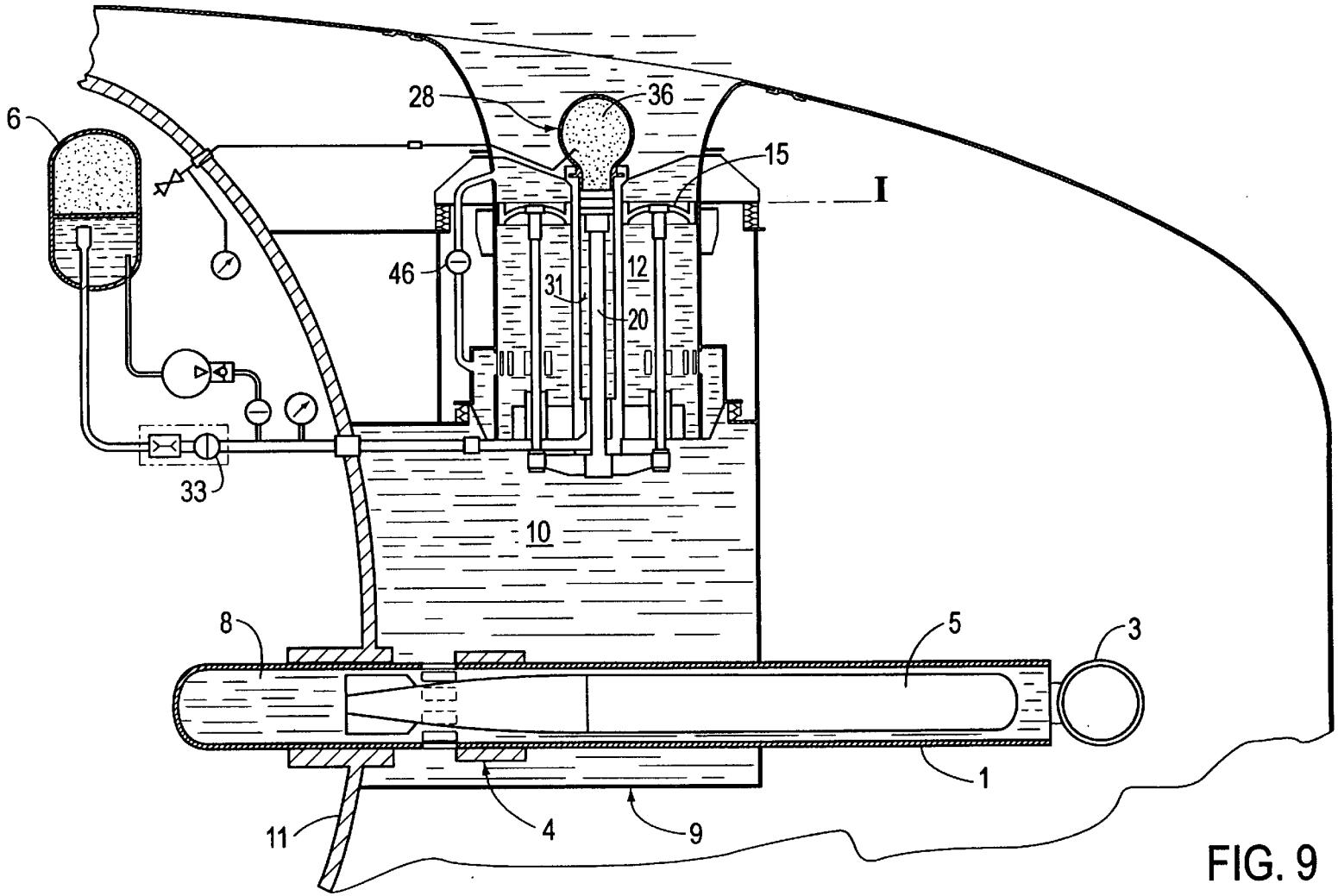
FIG. 9 is a schematic diagram of the device according to the invention in the pre-launch phase.

The water discharge device operates as follows with respect to FIGS. 9, 10 and 11. According to FIG. 9 corresponding to the pre-launch situation of the device, the torpedo tube 1 containing a weapon 5 to be launched has been prefilled with water and the pressure in the interior space 8 has been equalized with the pressure in the interior space 10. Then, the doors 3, 4 are opened and the equalizing valve 46 is closed.

The pneumatic piston 20 connected to the concentric hydraulic piston 15, is held in position I by the space 31 filled with hydraulic fluid, the latter being unable to flow to compensating tank 6 when the valve 33 is kept closed. The interior 36 of the reservoir 28 is filled with gas at the pressure corresponding to the launch conditions.

Figure 10A:
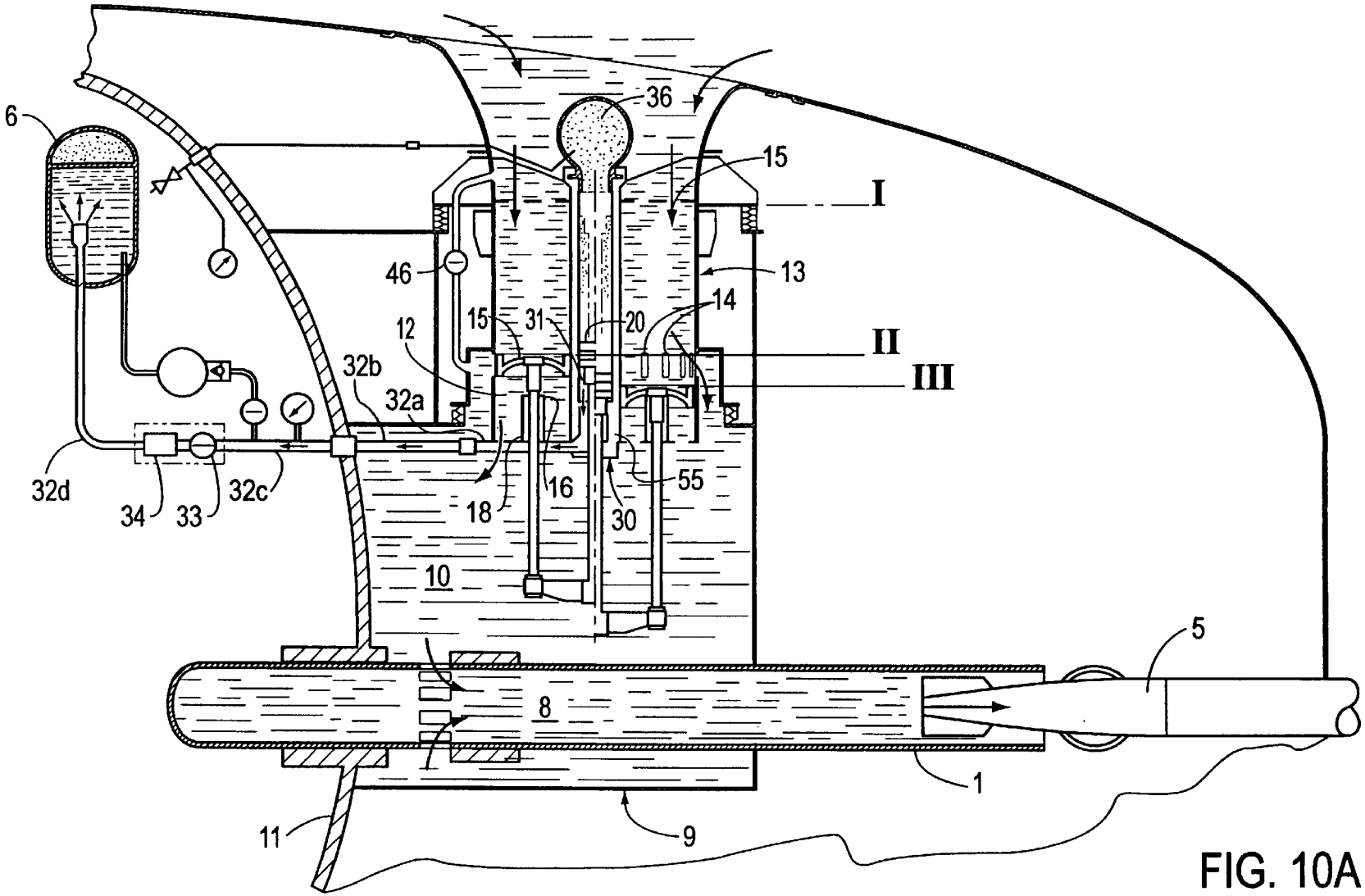
FIGS. 10*a* and 10*b* are schematic diagrams of the device according to the invention in the launch phase.

According to FIG. 10*a* corresponding to the launch position, the valve 33 is opened, causing discharge to the compensating tank 6 via pipe sections 32*a*–32*d* and through the device 34 that regulates the flow of the hydraulic fluid contained in interior space 31. The displacement of the pneumatic piston 20 to position II is caused by the pressure of the compressed gas contained in the reservoir 28. The concentric hydraulic piston 15 entrained by the pneumatic piston 20 pushes water from space 12 to space 10 of the impulse tank 9, and thus supplies the interior 8 of the torpedo tube 1 with water under pressure through the water inlet orifices 7, causing the weapon 5 to be launched and the space 12 to be supplied while the weapon 5 is traveling to its point of exit from the torpedo tube 1.

When the hydraulic piston 15 reaches position II, the braking devices 16 and 55 incorporated with the guides 18 and the flange 30, respectively, begin to act and slow down the movement of the pistons 15 and 20 between positions II and III. The movement is stopped when the piston 20 contacts the flange 30. While the piston 15 is moving between positions II and III, the piston 15 is gradually uncovering the ports 14 in the hydraulic cylinder 13 to supply the interior 10 of the impulse tank 9 with water from the outside environment to avoid a water hammer when the moving water column abruptly stops.

Figure 10B:
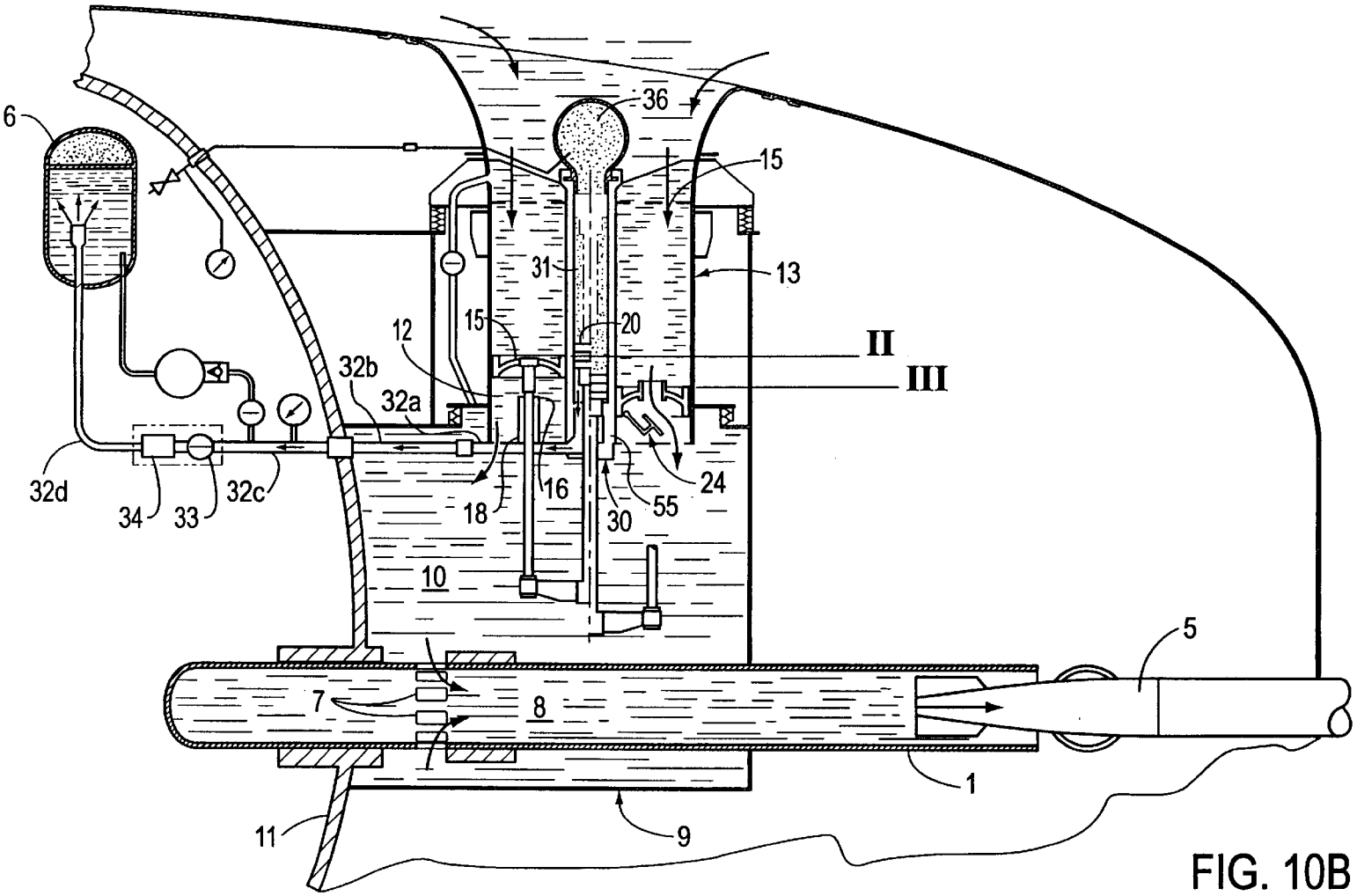

According to FIG. 10*b*, another embodiment is shown and can be designed to provide the latter function. For example, the ports 14 are eliminated and passage of water from the outside environment to the interior spaces 10, 12 when the piston 15 slows down, is provided through the openings in the float valves 24 whose characteristics (i.e., passage cross section, pressure differential causing them to open) are matched to this application (see FIG. 6).

Figure 11:
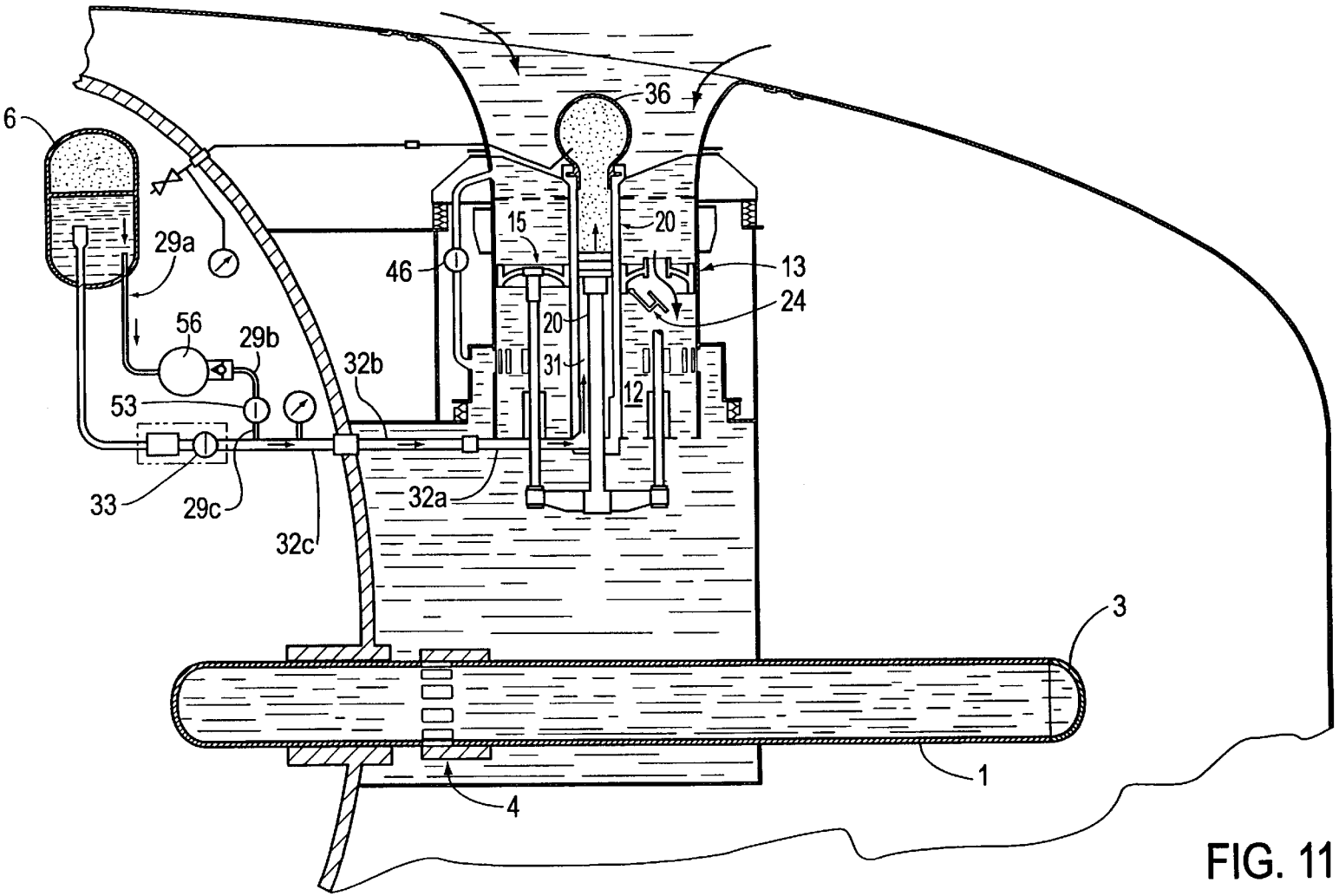
FIG. 11 is a schematic diagram of the device according to the invention in the post-launch phase.

Finally, according to FIG. 11 corresponding to the return of the device to the "armed" position, the door 4 of the torpedo tube 1 that has just ejected is closed, as is the firing valve 33. The equalizing valve 46 is re-opened.

The opening of the valve 53 and the starting of the pump 56, supply the interior 31 of the pneumatic ram 26 with hydraulic fluid under pressure, taken from the compensating tank 6 and through pipe sections 29*a*–29*c*, 32*a*–32*c*. The pressure generated by the pump 56 is such that, in view of the power section of pneumatic piston 20 on the hydraulic fluid side below the section of this same piston 20 on the compressed-gas side, the thrust generated by pressurization of space 31 is greater than the thrust due to the partially expanded compressed gas in the reservoir 28. The movement to position I of the piston 20 and the entraining piston 15 is then accomplished, as is compression of the gas contained in the reservoir 28.

While the piston 15 is returning to position I, the float valves 24 act as check valves and allow the water taken from the outside environment to pass to the interior 12 of the hydraulic ram 13.

When the piston 20 is once more in position I, the valve 53 is closed and the device is ready for a new launch once the pressure of the compressed gas in the reservoir 28 has been adjusted to nominal pressure.

The device described above is also applicable to ejection of decoys and all other types of counter-measures, as well as ejection of recoverable underwater propelled bodies or ejection of inert bodies for deballasting operations.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A water discharge device for launching objects from a submerged structure having a pressure hull, an outer hull with an opening therein, and an impulse tank, the impulse tank being a closed and sealed space, the water discharge device comprising:

a hydraulic ram;

a pneumatic ram, coupled to the hydraulic ram, the pneumatic ram acting on the hydraulic ram to drive water into the impulse tank;

wherein the impulse tank is immovably located in the outer hull and the pneumatic ram and the hydraulic ram are removably mounted so that they can be placed in the impulse tank thereby sealing the impulse tank or be disassociated from the impulse tank, by passing the water discharge device through the opening and sealing the water discharge device in the opening without maintenance work on the hull.

2. The device according to claim 1, wherein the pneumatic ram further comprises a pneumatic piston connected to an annular discharge piston so that a concentric crown is formed around the pneumatic ram, the pneumatic piston being able to move linearly and simultaneously with the annular discharge piston, in a corresponding concentric interior of the hydraulic ram.

3. The device according to claim 2, further comprising:

a compressed-gas reservoir being in communication with the pneumatic piston, the compressed-gas reservoir applying pressure to directly drive the pneumatic piston displaceably using no intermediate line.

4. The device according to claim 3, wherein the pneumatic piston and the annular discharge piston are connected by a yoke, the center of the yoke being connected perpendicularly to the pneumatic piston and the ends of the yoke being connected perpendicularly to connecting rods of the annular discharge piston, the yoke thus permitting an integrated coupling of the pneumatic piston and the annular discharge piston movable with respect to the interiors of pneumatic ram and hydraulic ram.

5. The device according to claim 4, further comprising:

a flange and seals, the flange and seals allowing the pneumatic ram to directly communicate with the compressed-gas reservoir and isolate the interiors of pneumatic ram and compressed-gas reservoir from outside environmental elements.

6. The device according to claim 5, further comprising:

at least one compressed-gas line to provide communication between the interior of the compressed-gas reservoir and a submarine compressed-gas production and distribution source.

7. The device according to claim 6, wherein the annular discharge piston comprises drain float valves placed between the connection of the annular discharge piston and connecting rods, the drain float valves bleeding the air trapped in an interior space of hydraulic ram and supply the interior space with water from outside the interior space when the annular discharge piston returns to a post-launch position.

8. The device according to claim 7, wherein an interior of the pneumatic ram contains a hydraulic fluid, the hydraulic fluid flowing between the interior of the pneumatic ram and a compensating tank through hydraulic fluid lines comprising a flange to which pipe sections are connected, a valve, and a flow regulator, the flow regulator controlling the hydraulic fluid discharged to compensating tank when annular discharge piston is displaced.

9. The device according to claim 8, wherein the hydraulic fluid lines further comprise a pump that drives the hydraulic fluid contained in compensating tank through pipe sections into the interior space of the pneumatic ram, the hydraulic fluid causing the annular discharge piston to move from a post-launch to a pre-launch position.

10. The device according to claim 9, wherein the valve shuts off the hydraulic fluid lines when the hydraulic fluid lines are not in use.

11. The device of claim 10, further comprising a check valve to prevent the hydraulic fluid lines from being pressurized upstream of the valve.

12. The device according to claim 1, further comprising:

a support located above the hydraulic ram and connected to a structure integral with the impulse tank by elastic connections.

13. The device according to claim 1, further comprising:

a water intake duct as a part of the water discharge device connected to the hull and having a flexible seal to ensure the continuity of the hull's profile, the water intake duct being fitted with a grid.

14. The device according to claim 1, further comprising:

at least one water line composed of pipe sections and valve, which can be open or closed, the at least one water line equalizing the pressure between the interior spaces of hydraulic ram and the impulse tank respectively, and an outer environment.

15. The device according to claim 1, wherein the water discharge device is installed in an upper part of the submerged structure, the water discharge device further comprising removable connectors being placed between water and hydraulic lines so that, after the lines are disconnected, the water discharge device can pass through the opening in the outer hull at the upper part of the submerged structure.

16. The device according to claim 1, wherein the water discharge device requires only fluid connections, electrical connections, and launch tubes, passing through the hull.

17. A water discharge device for launching objects from a submerged structure having a hull and a impulse tank, the impulse tank being a closed and sealed space, comprising:

a hydraulic ram;

a pneumatic ram, coupled to the hydraulic ram, the pneumatic ram acting on the hydraulic ram to drive water into the impulse tank;

a pneumatic piston connected to an annular discharge piston so that a concentric crown is formed around the pneumatic ram, the pneumatic piston being able to move linearly, simultaneously with the annular discharge piston, in a corresponding concentric interior of the hydraulic ram;

the pneumatic piston and the annular discharge piston are connected by a yoke, the center of the yoke being connected perpendicularly to the pneumatic piston and the ends of the yoke being connected perpendicularly to connecting rods of the annular discharge piston, the yoke thus permitting an integrated coupling of the pneumatic piston and the annular discharge piston is movable with respect to the interiors of pneumatic ram and hydraulic ram;

wherein the chamber is immovably located outside hull while the pneumatic ram and the hydraulic ram are removable and independent so that they can be placed in the chamber or be disassociated from the chamber, without maintenance work on the hull, and wherein the water discharge device is installed in an upper part of the submerged structure, the water discharge device further comprising removable connectors being placed between water and hydraulic lines so that, after the lines are disconnected, the assembly is allowed to pass through openings in the upper part of the submerged structure.

18. The device according to claim 17, further comprising:

a compressed-gas reservoir being in communication with the pneumatic piston, the compressed-gas reservoir applying pressure to directly drive the pneumatic piston displaceably using no intermediate line.

19. The device according to claim 18, further comprising:

a flange and seals, the flange and seals allowing the pneumatic ram to directly communicate with the compressed-gas reservoir and isolate the interiors of pneumatic ram and compressed-gas reservoir from outside environmental elements.

20. The device according to claim 19, further comprising:

at least one compressed-gas line to provide communication between the interior of the compressed-gas reservoir and a submarine compressed-gas production and distribution source.

* * * * *